US007445130B2

(12) United States Patent
Bosl et al.

(10) Patent No.: US 7,445,130 B2
(45) Date of Patent: Nov. 4, 2008

(54) CLOSURE CAP

(75) Inventors: Udo Bosl, Eimeldingen (DE); Patrick Habersaat, Reinach (CH)

(73) Assignee: Obrist Closures Switzerland GmbH, Reinach (CH)

( * ) Notice: Subject to any disclaimer, the term of this patent is extended or adjusted under 35 U.S.C. 154(b) by 0 days.

(21) Appl. No.: 10/486,658

(22) PCT Filed: Aug. 9, 2002

(86) PCT No.: PCT/EP02/08948

§ 371 (c)(1),
(2), (4) Date: Aug. 11, 2004

(87) PCT Pub. No.: WO03/016161

PCT Pub. Date: Feb. 27, 2003

(65) Prior Publication Data

US 2005/0000931 A1 Jan. 6, 2005

(30) Foreign Application Priority Data

Aug. 13, 2001 (EP) ..... 01306874

(51) Int. Cl.
*B65D 41/34* (2006.01)

(52) U.S. Cl. ..... 215/252; 215/258

(58) Field of Classification Search ..... 215/252, 215/253–258, 318

See application file for complete search history.

(56) References Cited

U.S. PATENT DOCUMENTS 4,402,418 A * 9/1983 Ostrowsky ..... 215/252
4,550,844 A 11/1985 Lininger
4,657,153 A 4/1987 Hayes
4,801,030 A * 1/1989 Barriac ..... 215/252
4,813,561 A * 3/1989 Ochs ..... 215/252
4,997,097 A * 3/1991 Krautkramer ..... 215/307
5,007,545 A * 4/1991 Imbery, Jr. ..... 215/14
5,090,788 A 2/1992 Ingram et al.
5,205,426 A * 4/1993 McBride et al. ..... 215/252
5,242,068 A * 9/1993 McCandless ..... 215/252
5,356,019 A 10/1994 Kelly
5,400,913 A 3/1995 Kelly
5,695,083 A * 12/1997 Obadia ..... 215/329
5,749,484 A * 5/1998 Trout ..... 215/219
5,775,527 A * 7/1998 Bosl et al. ..... 215/252
5,860,542 A * 1/1999 Takamatsu ..... 215/44
5,913,437 A 6/1999 Ma (Continued)

FOREIGN PATENT DOCUMENTS

CN 1271681 11/2000

(Continued)

*Primary Examiner*—Lien T Ngo
(74) *Attorney, Agent, or Firm*—Knoble, Yoshida, & Dunleavy, LLC

(57) ABSTRACT

A closure (10) is provided and includes a tamper-evident band (40). The band (40) has a plurality of retaining flaps (60) which engage under a container neck annular retaining bead (23) when the closure is first applied. The flaps have a ratchet surface (86*a*, 190) for engaging a complimentary surface on the container neck (20). The flaps also have spacer means (85*a*, 85*b*, 186) for pushing them into a more vertical inclination under the bead (23). The ratchet arrangement and spacer means ensure reliable separation of the tamper-evident band (40).

10 Claims, 6 Drawing Sheets

U.S. PATENT DOCUMENTS

| | | | | |
|---|---|---|---|---|
| 5,964,139 | A | 10/1999 | Spatz et al. | |
| 6,044,995 | A * | 4/2000 | Dai | 215/354 |
| 6,112,923 | A | 9/2000 | Ma | |
| 6,213,321 | B1 * | 4/2001 | Zumbuhl | 215/252 |
| 6,276,543 | B1 * | 8/2001 | German et al. | 215/252 |
| 6,382,443 | B1 * | 5/2002 | Gregory | 215/252 |
| 2001/0002661 | A1 | 6/2001 | Reidenbach | |
| 2002/0033374 | A1 | 3/2002 | Ma | |
| 2003/0102280 | A1 | 6/2003 | Odet et al. | |

FOREIGN PATENT DOCUMENTS

| | | | |
|---|---|---|---|
| EP | 0 072 924 | B1 | 5/1989 |
| EP | 0 410 059 | A1 | 1/1991 |
| EP | 0 593 396 | A1 | 10/1993 |
| FR | 2 525 565 | | 10/1983 |
| JP | 08-164960 | | 6/1996 |
| WO | WO 01/51375 | A1 | 7/2001 |

* cited by examiner

CLOSURE CAP

BACKGROUND OF THE INVENTION

The present invention is concerned generally with a closure cap having a tamper-indicating band, and particularly to such a closure in which a plurality of flaps are provided on the tamper-indicating band for engaging an annular retaining bead on a container to retain the band on the container.

Closure caps of this type generally comprise a top panel with a cylindrical skirt depending from the periphery thereof. A tamper-indicating band is in some way frangibly connected to the open end of the skirt. The tamper-indicating band has retaining flaps which extend radially inwardly and towards the top panel to allow engagement under an annular retaining bead on a container. When the closure cap is removed from the container for the first time, for example by unscrewing, the flaps apply torque to the band and prevent the band from following the upper portion of the cap in its upwardly translational movement. The tamper-evident band is retained on the container as visible evidence that the container has already been opened.

Tamper-evident closure caps of this general type are well known within the art. For example, patent document U.S. Pat. No. 4,550,844 describes a tamper-evident band with a plurality of wedge-shaped tabs that contact a retaining bead on a container. The thicker outer portion of the tabs wedge against the container retaining bead to apply torque to the tamper-evident band and break frangible bridges which connect the band to the rest of the cap.

Closure caps of this type are generally moulded with the flaps connected to the bottom of the tamper-evident band from where they depend in such a way that they can hinge. Following moulding the flaps are then upturned before the closure is applied to the container and the flaps pass over the container retention bead with hinging movement. It is particularly important in closure caps of this type that the tamper-indicating band remains on the container as the upper portion of the cap is unscrewed. The design of the flaps is therefore preferably such that when an upwardly axial force is applied to the tamper-evident band the flaps do not flip back down to their as-moulded condition such that the band can pass back over the container retention bead. In addition, the flaps must be flexible enough to pass over the retention bead when the cap is first applied to the container. This could be achieved, for example, by the use of longer flaps.

Whilst strengthening of the flap, for example by increasing its thickness or its length, improves retention of the tamper-evident band on the container, this decreases the ability of the flap to pass over the retaining bead as the closure cap is applied to the container. In addition the amount of material used is increased and the dimensions of the container and closure cap within which the flaps can be used is more limited.

As an alternative to upturned flaps the use of ratchet arrangements to break tamper-evident bands is known, for example, from JP 08164960. However, the ratchets are moulded projecting radially inwardly and thus present problems with de-moulding and with application to a container neck.

SUMMARY OF THE INVENTION

According to the present invention there is provided a closure cap, the closure comprising a top panel, a cylindrical skirt depending from the periphery of the top panel, and a tamper-evident band frangibly connected to the open end of the skirt, the tamper-evident band has a plurality of circumferentially spaced retaining flaps, in use the retaining flaps extend radially inwardly and are directed towards the top panel so as to engage under an annular retaining bead on a container neck, characterised in that, the flaps include a ratchet surface adapted to engage a corresponding surface on the container neck, and in that the retaining flaps include spacer means which push the flap away from the neck.

The present invention ensures that the tamper-evident band breaks away from the skirt upon unscrewing of the closure by applying bi-directional force to the frangible connection. The first component of force is a shear force provided by the engagement of the ratchet surface on the container with the ratchet surface on the retaining flaps. The second component of force is a vertical force provided by the engagement of the retaining flaps under the annular retaining bead of the container. The flap provides both a ratchet surface and a spacer means.

In order that the vertical force applied to the frangible connection is maximised the flaps need to be positioned as vertically as possible, whilst maintaining contact under the retaining bead. The spacer means of the flaps push the flaps away from the container neck, reducing the angle between the flap and the main wall of the tamper-evident band.

A particularly pertinent application of the present invention is for beer bottles. Closure caps which are used for beer bottles preferably have a shorter skirt and tamper-evident band than is standard to imitate a metal crown. So-called short twist-off closures present problems with tamper-evidence because the vertical distance the closure moves is reduced. In addition, the tamper-evident band needs to be as short as possible, which consequently reduces the maximum length of retaining flaps. Reliable tamper-evidence must be achieved whilst retaining ease of application. The ability to maximise forces applied to the frangible connection allows the height of the closure to be reduced. A standard 28 mm diameter closure is approximately 19 mm tall (including the tamper-evident band). Using the present invention closures of 14.4 mm have proved to function reliably. The reduction in height gives a corresponding reduction in material.

The use of hinged flaps which are moulded in a downward condition and then folded into the closure prior to application is an advantage, because the flaps can hinge towards the tamper-evident band as they pass over container retaining bead. However, the nature of plastics materials is such that the flaps try to return to their original downward-most position, i.e. away from the tamper-evident band wall and towards the neck finish. This means that the flaps tend to move to a less vertical inclination, with a corresponding reduction in the vertical force exerted on an annular retaining bead.

Additionally in order to improve the ease of application, a wider diameter tamper-evident band can be used. Without a spacer means this problem of the flap moving towards and then resting against the neck finish would be worse.

The spacer means may be a fin, and in one embodiment there are two fins, located at each lateral edge of the flap. With this arrangement, as the closure cap is first applied to the container and the flaps are required to pass over the retainer retention bead, the flap can flex between the fins.

The spacer means may be formed by a fold in part of the flap. For example, by folding part of a flap radially inwardly (when the flap is in use) this may be used to produce a fin. As an additional benefit, by folding the flap its rigidity can be improved. Because the flap is inclined upwards and inward after placement on to the container and the flaps engage with their free edge onto the container, the forces arising during opening of the closure cap are transferred by the flaps to the tamper-indicating band approximately along their longitudinal axis. The use of folds which may, for example, be along the longitudinal axis of the flap can be used to improve the rigidity of the flap in that direction. In this case therefore the flaps can brace more firmly against the container in addition to being pushed away from it. In one embodiment in which two lateral fins are created through an inward folding of the edges of the flap, the width of the fins increases towards the free edge of the flap to increase the area of contact with the container. Corrugated flaps could be used but this uses more material than flaps which are simply folded once at either side to form lateral fins.

In one embodiment the thickness of the flap is substantially uniform throughout its length. This is particularly relevant to flaps in which an inward folding is used to improve the retention of the flaps against the tamper-evident bead on the container.

In a preferred embodiment all of the retaining flaps have spacer means. However, it is of course possible for only a proportion of the retaining flaps, for example alternate flaps, to include spacer means and still effect the overall retention of the tamper-evident band on the container. The proportion of flaps which have this spacer element should therefore be sufficient to retain the band on the container and will be dependent on the specific design of the cap.

The present invention also provides the combination of a closure cap and a container, the closure comprising a top panel, a cylindrical skirt depending from the periphery of the top panel, and a tamper-evident band frangibly connected to the open end of the skirt the tamper-evident band has a plurality of circumferentially spaced retaining flaps, in use the retaining flaps extend radially inwardly and are directed towards the top panel so as to engage under an annular retaining bead on the container neck, characterised in that, the container neck includes one or more ratchet elements mutually spaced under the annular retaining bead, the flaps include a ratchet surface for engaging the ratchet elements, and in that the retaining flaps include spacer means which push them away from the neck.

The present invention will now be more particularly described, by way of example, with reference to the accompanying drawings, in which:

DETAILED DESCRIPTION OF THE PREFERRED EMBODIMENTS

Figure 1:
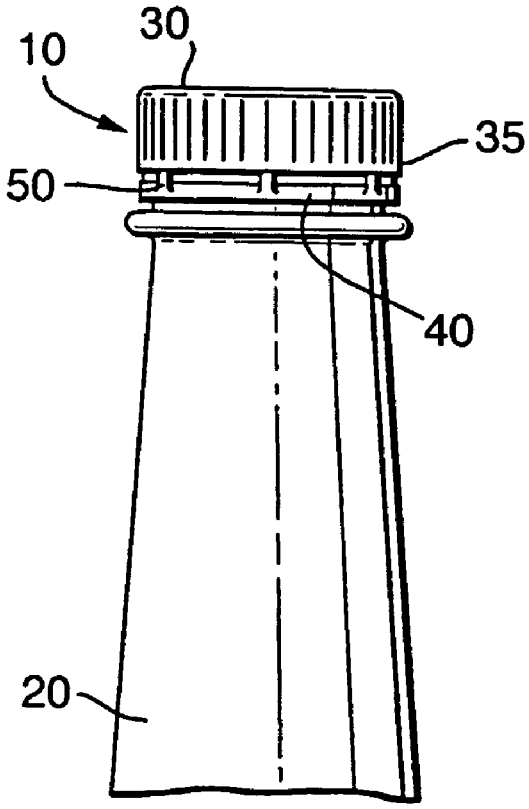
FIG. 1 is a side view of a closure cap according to the present invention, shown attached to a container.

Referring first to FIG. 1 there is shown a closure cap generally indicated (10) which is attached to a container neck (20), in this case-from a beer bottle. The closure cap (10) comprises a top panel (30) with a cylindrical skirt (35) depending from its periphery. A tamper-evident band (40) is frangibly connected to the open end of the skirt (35) by a plurality of frangible bridges (50). The length of the cap (10) is approximately 14 mm; a standard plastics cap for bottles is approximately 20 mm. In this embodiment the cap (10) as a whole and the band (40) are much shorter than usual, although of course the present invention is not limited to such closures. Whilst not illustrated, the cap may include a liner, such as a gas scavenging liner, which may be particularly useful for products such as beer which are sensitive to oxygen.

Figure 2:
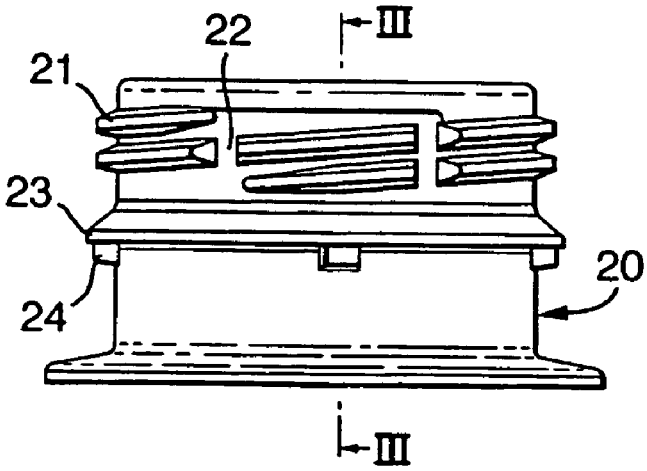
FIG. 2 is a side view of the container neck finish of FIG. 1.
Figure 3:
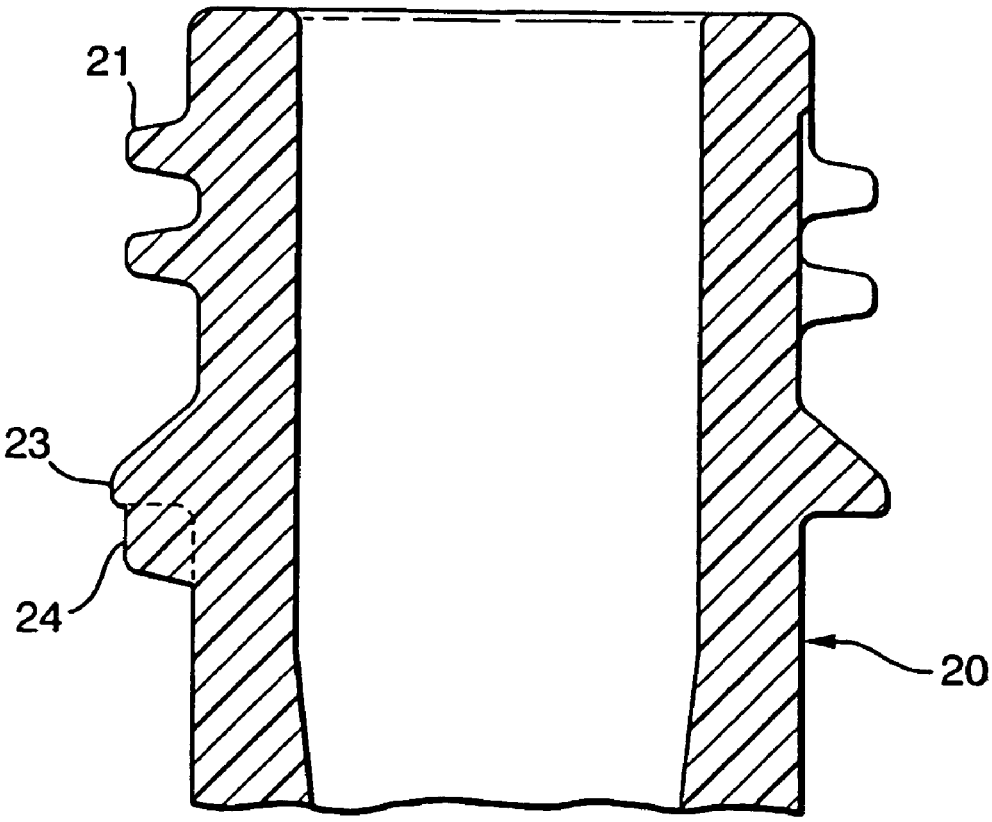
FIG. 3 is a section through line III-III of FIG. 2.

Referring now to FIGS. 2 and 3, the-container neck (20) is shown in more detail. The neck (20) has a single start thread (21) which includes several venting slots (22). Below the thread (21) is an annular retaining bead (23). Below the bead (23) are a plurality of circumferentially spaced wedge-shape ratchet teeth and elements (24).

Figure 4:
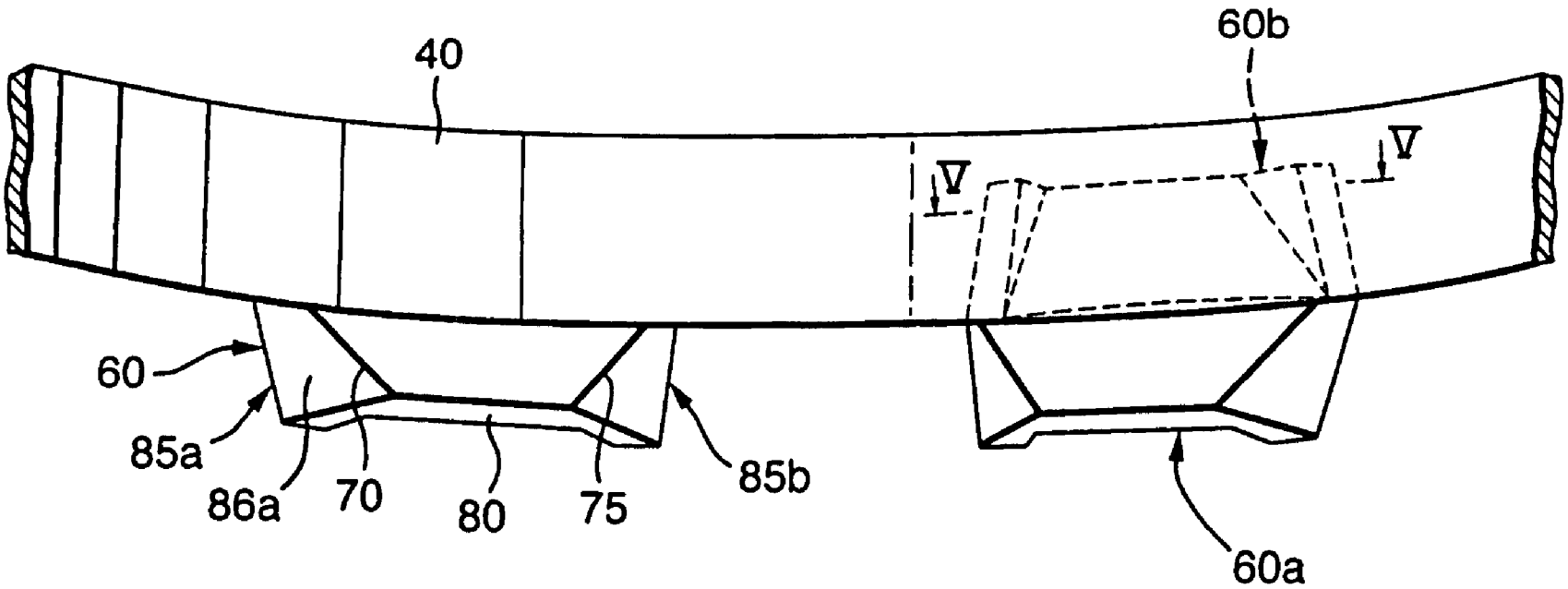
FIG. 4 is a perspective view of part of a tamper-evident band having retaining flaps according to the present invention, shown in an as-moulded condition and prior to application.

Referring now to FIG. 4 the tamper-indicating band (40) has a plurality of circumferentially spaced retaining flaps (60) connected to its end remote from the skirt (35). The flaps (60) are moulded as generally rectangular plates, which in this embodiment are of substantially uniform thickness. Each flap is moulded so as to be folded along lines (70, 75). The folds result in a flap comprising a generally trapezoidal centre section (80) with two generally triangular lateral fins (85*a*, 85*b*). The flaps (60) are turned upwardly before or as the closure cap (10) is applied to a container (20). This is represented on the tight hand side of FIG. 2 with the flap (60*a*) shown in its downwardly directed position, and the same flap shown in its upwardly directed position indicated 60*b*. Whilst in this embodiment the flaps (60) are moulded with the fins already present, the flaps could be processed to introduce fold lines, pleats or the like.

Figure 5:
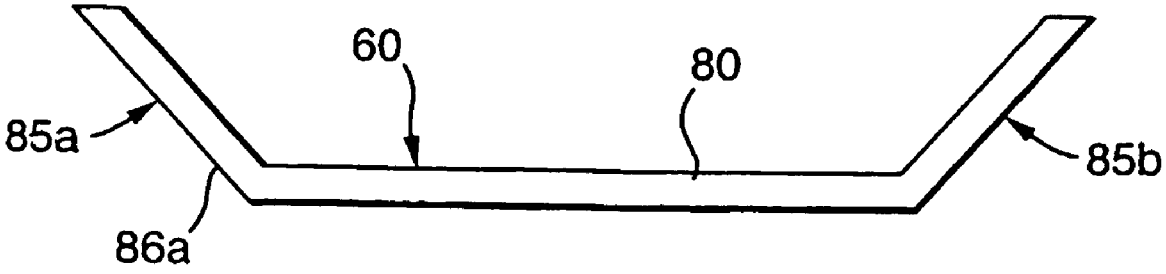
FIG. 5 is a section through line V-V of one of the retaining flaps shown in FIG. 4.

FIG. 5 shows section through a flap (60) in which the fins (85*a*, 85*b*) can clearly be seen to extend radially outwardly of the central section (80).

Figure 6:
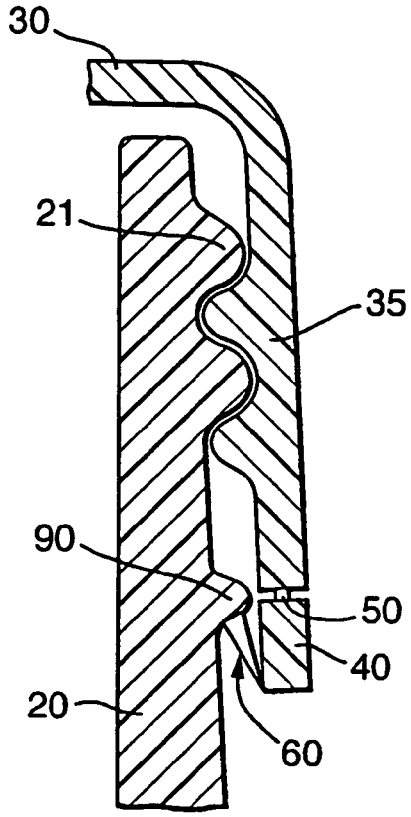
FIG. 6 is a section through the closure/container combination of FIG. 1 showing retaining flaps upturned to engage under an annular retaining bead.
Figure 7:
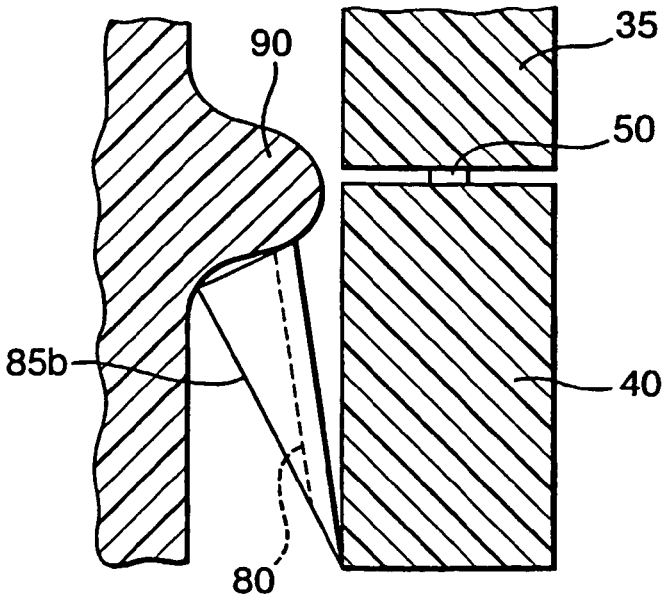
FIG. 7 is a magnified view of FIG. 6 illustrating the function of the retaining flaps.

Referring now to FIGS. 6 and 7, the closure cap (10) is shown attached to the container (20). In this embodiment the flaps are moulded to be substantially horizontal i.e. orthogonal to the main cap axis. The flaps are turned up as the cap is applied to the bottle by the capping action. As the closure cap (10) is pushed on to the container the flaps (60) must pass over an annular retaining bead (23) on the container (20). It will be appreciated that as the fins (85*a*, 85*b*) pass over the bead (90) the fins (85*a*, 85*b*) can flex outwardly which helps application of the closure. In the position shown in FIGS. 6 and 7 the flaps (60) are engaged under the bead (23). It will be appreciated from FIG. 7 that the inclusion of the fins (85*a*, 85*b*) holds the flap more vertically. Once the closure is applied, the outer surface (86*a*) of the fin (85*a*) serves as a ratchet surface (see FIG. 5). When the closure is unscrewed the surface (86*a*) engagesone of the teeth (24) on the container neck and prevents rotation of the band (40). This exerts shearing forces on the frangible bridges (50) which connect the band (40) to the skirt (35). In addition, the tops of the fins (85*a*, 85*b*) and the section (80) engage under the bead (23) to exert vertical forces on the bridges (50) as the closure begins to travel up the thread (21). This vertical force is maximised because the flaps (60) are held close to the vertical due to the fins (85*a*, 85*b*). In addition the fins (85*a*, 85*b*) help to prevent the flaps from flipping downwardly towards their as-moulded position. This is in part due to the fact that the flaps (60) are held more vertically than they otherwise would be, such that the resultant force from an axial force exerted on the tamper-indicating band is transferred more effectively to the band and the annular retaining bead than if the flap is at an increased angle away from the vertical. The fins increase the effective width of the flaps without increasing the amount of material used. In addition, the fold lines (70, 75) which define the fins (85*a*, 85*b*) increase the longitudinal rigidity of the flaps (60) which helps to prevent a simple transverse folding of the flaps allowing the tamper-indicating band (40) to pass over the annular retaining bead (23).

It will be appreciated that the use of the fins is only one way in which the flaps (60) can be pushed away from the container in this way. For example, one or more surface projections such as a rib or boss could be used to produce the same effect. The fin embodiment is, however, viewed as particularly advantageous because this uses the least amount of material and in addition results in the increased rigidity properties without requiring an increase in material thickness, as described above.

The frangible connection of the tamper-indicating band to the open end of the skirt may of course be achieved in a number of ways, for example, by the use of frangible bridges or by a localised thinning at the interface of the tamper-indicating band and the open end of the skirt.

The band may be a standard tamper-evident band or a 'pigtail' type band in which part of the band remains permanently attached to the rest of the closure.

It is not possible to mould the flaps inclined upwardly without the use of complex and expensive moulding equipment. The flaps are therefore preferably moulded in a downward position and are able to pivot, at least to some extent, with respect to the band. In this embodiment the flaps can pivot about the line along which they are connected to the band; the line effectively forms a film hinge. However, if this flexibility about the line along which the flap is joined to the band is too great this affects the ability of the flap to resist downward flipping.

Figure 8:
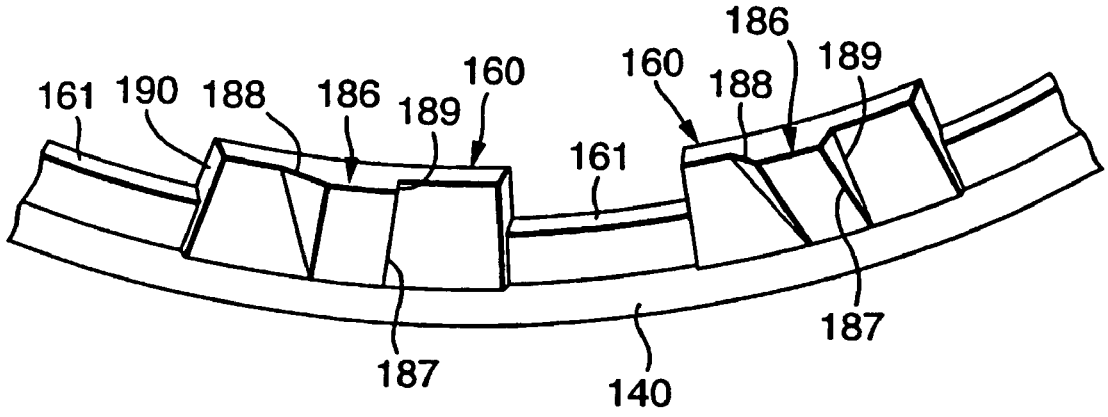
FIG. 8 is a perspective view of the underside of part of a tamper-evident band according to a further embodiment.

Referring now to FIG. 8 there is shown an alternative embodiment. In FIGS. 1 and 4 to 7 the flaps are completely separate from each other. In this embodiment opposing lateral edges (190) of the flaps (160) are connected by moulded bridges in the form of intermediate webs (161) which extend from the band (140) at least part of the way up the flaps. The webs (161) reduce the flexibility of the flaps to help prevent them from pivoting downwards in response to axial force applied to the band, for example during unscrewing of the closure. The flaps (160) do not have the lateral fins of the embodiment shown in FIGS. 1 and 4 to 7. Instead, each flap (160) has a wedge element (186). Each wedge element (186) comprises a generally rectangular ramped central portion (187) which extends from the base of the flap (160) at the point of attachment to the band (140), to its outside edge. A generally triangular ramped lateral portion (188) extends from one side of the central portion (187) and is inclined in the direction the closure will be screwed onto the container.

When the closure is fitted to the container the wedge elements (186) have the same effect as the fins (85*a*, 85*b*) in terms of pushing the flaps away from the container so that they lie more vertically, and in terms of strengthening the flaps along their longitudinal axis. In this embodiment the closure may be applied to a container with circumferential ratchet teeth located below the retention bead. The closure can be rotated on to such a container because the lateral portion (188) of each wedge element allows it to pass over the teeth (24) and slots (22) in this direction. When the closure is rotated off the container the ratchet teeth contact one lateral edge (190) of the flap; this therefore prevents rotation of the band.

Figure 9:
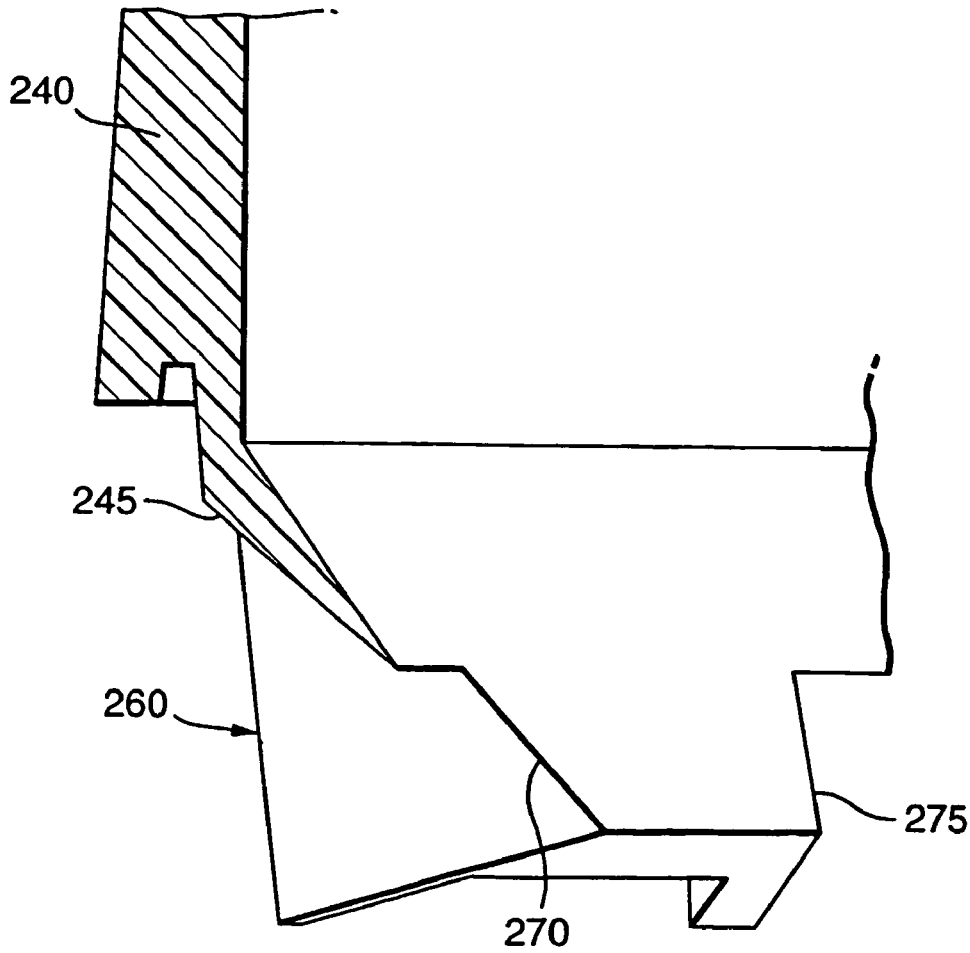
FIG. 9 is a perspective view of part of a tamper-evident band according to a further embodiment.

A further embodiment is shown in FIG. 9. In this embodiment the flexibility of the flaps (260) is reduced, but they are not interconnected by moulded bridges as in FIG. 6. Instead, the flaps (260) are further connected to the band (240) by triangular webs (245) which extend from the lines (270, 275) to the band (240). The webs (245) extend only partially between adjacent flaps.

Figure 10:
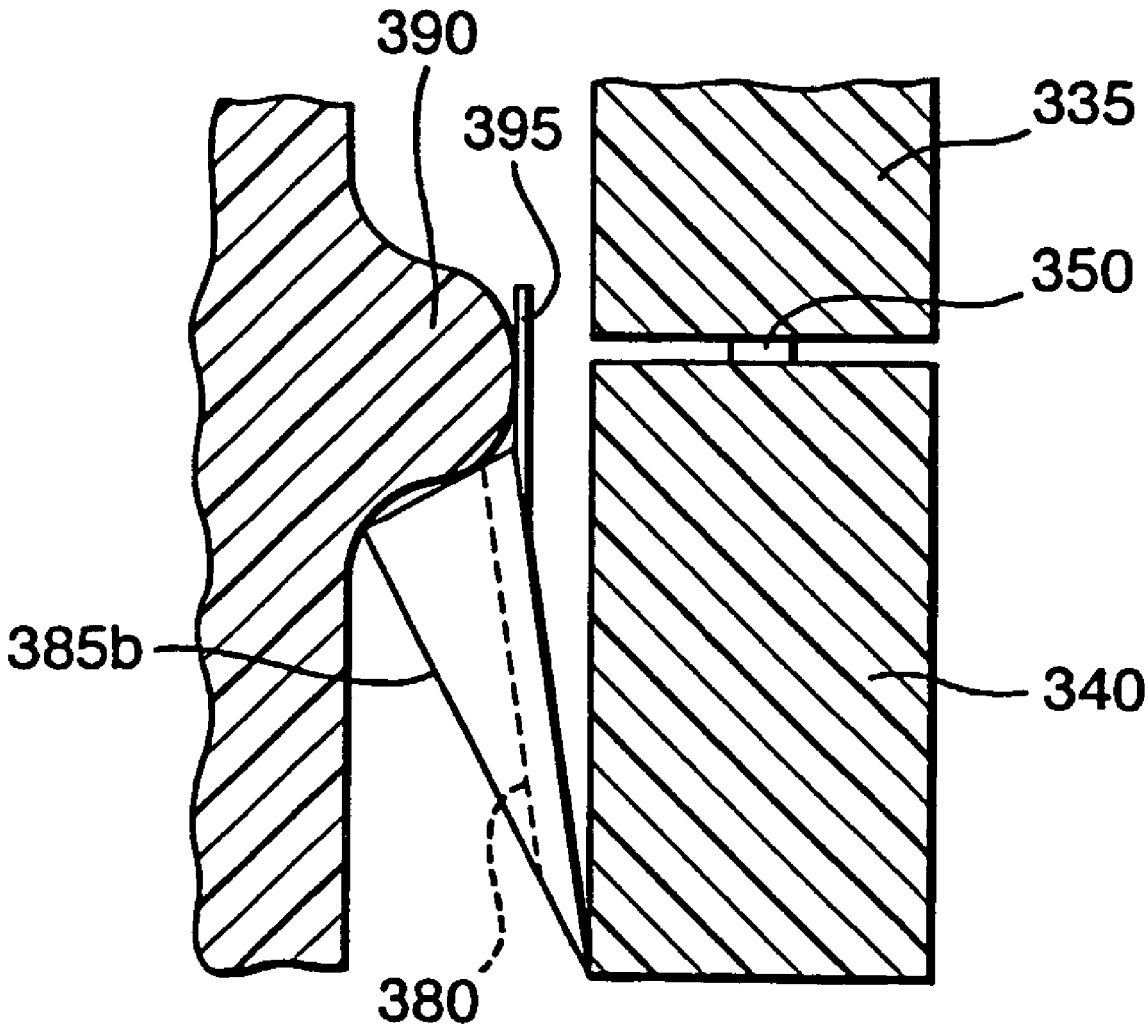
FIG. 10 is a section through a container shown with a closure formed according to a still further embodiment.

Referring now to FIG. 10 there is shown a still further embodiment. In this embodiment a rectangular tab (395) extends from the centre of the outside edge of the flap (360). In use, the tab (395) extends at least up to the level of the retaining bead (390) of the container. As such the tab (395) exerts force on the retaining bead (395) further to prevent the flaps (360) from flicking down.

Although a preferred embodiment of the invention has been specifically illustrated and described herein, it is to be understood that minor variations may be made in the apparatus without departing from the spirit and scope of the invention, as defined by the appended claims.

What is claimed is:

1. In combination, a closure cap (10) and a container neck (20), the closure cap (10) comprising a top panel (30), a cylindrical skirt (35) depending from the periphery of the top panel, and a tamper-evident band (40) frangibly connected to the open end of the skirt, the tamper-evident band (40) has a plurality of circumferentially spaced retaining flaps (60), in use the retaining flaps extend radially inwardly and are directed towards the top panel so as to engage under an annular retaining bead (23) on the container neck (20), characterised in that, the flaps (60) include spacer means (85*a*, 85*b*, 186) which push them away from the neck (20), wherein the spacer means is at least two generally triangular fins which are located at lateral edges of a generally trapezoidal section (80) of the flap.

2. A closure cap (10), the closure cap (10) comprising a top panel 30), a cylindrical skirt (35) depending from the periphery of the top panel, and a tamper-evident band (40) frangibly connected to the open end of the skirt, the tamper-evident band (40) has a plurality of circumferentially spaced retaining flaps (60), in use the retaining flaps extend radially inwardly and are directed towards the top panel (30) so as to engage under an annular retaining bead (23) on a container neck (20) and said flaps have a base at a point of attachment to the band and an outside edge opposite to the base, characterised in that, the flaps (60) include spacer means (85*a*, 85*b*, 186) which push the flap away from the neck (20), wherein the spacer means is at least two generally triangular fins which are located at lateral edges of a generally trapezoidal section (80) of the flap.

3. The closure cap (10) as defined in claim 1, wherein the flaps (60) are connected to the lower edge of the tamper-evident band (40) for hinged movement so that they can be turned from a downward, as-moulded condition to an upward condition prior to application to the container.

4. The closure cap (10) as defined in claim 1, wherein the flaps (60) include ratchet surfaces (86*a*, 190) adapted to engage a corresponding surface on the container neck.

5. The closure cap (10) as defined in claim 4, wherein the ratchet surface (86*a*, 190) of the flap is a lateral edge.

6. The closure cap (10) as defined in claim 1, wherein the spacer means (85*a*, 85*b*) is formed by a fold in part of the flap (60).

7. The closure cap (10) as defined in claim 1, wherein the spacer means increases in width towards the free edge of the flap (60).

8. The closure cap (10) as defined in claim 1, wherein the length of the closure cap is no greater than 15 mm.

9. The closure cap (110) as defined in claim 1, wherein adjacent flaps (160) are interconnected by intermediate web elements (161).

10. The closure cap (10) as defined in claim 3, wherein the flaps (60) include ratchet surfaces (86*a*, 190) adapted to engage a corresponding surface on the container neck and the ratchet surface (86*a*, 190) of the flap is its lateral edge.

* * * * *